US005437338A

United States Patent [19]

Martin et al.

[11] Patent Number: 5,437,338

[45] Date of Patent: Aug. 1, 1995

[54] HYDRAULIC DRIVE UNIT FOR DRIVING A DRILLING TOOL

[75] Inventors: Louis Martin, Compiegne; Ulrich Hager, Cernoy, both of France

[73] Assignee: Poclain Hydraulics, France

[21] Appl. No.: 162,492

[22] Filed: Dec. 3, 1993

[30] Foreign Application Priority Data

Dec. 11, 1992 [FR] France ..... 92-14970

[51] Int. Cl.[6] ..... F21B 3/02

[52] U.S. Cl. ..... 173/47; 173/206; 173/222

[58] Field of Search ..... 173/47, 48, 126, 127, 173/206, 207, 218, 222, 93, 179

[56] References Cited

U.S. PATENT DOCUMENTS

| | | | |
|---|---|---|---|
| 1,717,999 | 6/1929 | Olsen | 173/222 |
| 1,913,003 | 6/1933 | Shaff | 173/222 |
| 3,074,381 | 1/1963 | Osgood | 173/206 |
| 3,406,763 | 10/1968 | Worman | 173/47 |
| 3,766,995 | 10/1973 | Young et al. | 175/53 |
| 4,854,395 | 8/1989 | Kassieur et al. | 173/218 |

FOREIGN PATENT DOCUMENTS

| | | | |
|---|---|---|---|
| 2025354 | 9/1970 | France | F03C 1/00 |
| 2504897 | 11/1982 | France | F04B 1/10 |
| 2606828 | 5/1988 | France | E21B 19/14 |
| 4020111 | 1/1992 | Germany | F03C 1/26 |

*Primary Examiner*—Scott A. Smith
*Attorney, Agent, or Firm*—Ladas & Parry

[57] ABSTRACT

This invention relates to a drive unit comprising a frame; a rotating shaft, a first fluid motor presenting a cam fixed with respect to the frame; and a cylinder block fast with the shaft driven by the first motor at a first speed of rotation.

According to the invention, the shaft presents a recess conveying a drilling fluid; the cylinder block of the first motor is coaxial to the axis of rotation; drive unit comprises a second motor coupled in rotation to the shaft and driving it at a second speed of rotation higher than the first speed of rotation; a first pinion gear is fast with and coaxial to the shaft; the second motor presents an output shaft fast with a second pinion gear meshing with the first pinion gear; and the first motor is of the type with "disengageable pistons".

One application is the production of a high-performance drilling assembly.

10 Claims, 2 Drawing Sheets

P18
54
53
D57
D6
D9
D56

HYDRAULIC DRIVE UNIT FOR DRIVING A DRILLING TOOL

FIELD OF THE INVENTION

The present invention relates to a hydraulic motor unit for driving a drilling or boring tool.

BACKGROUND OF THE INVENTION

A drilling/boring tool is driven in known manner by a hydraulic motor at a single speed of rotation, or within a range of speeds of rotation poorly adapted to the various operational phases.

It is an object of the invention to overcome the shortcomings observed, by providing the drive of the drilling tool over a range of speeds of rotation much larger than heretofore, and at the moment of drilling, with a greater torque.

SUMMARY OF THE INVENTION

The invention therefore relates to a motor unit comprising: a frame, a driven shaft mounted to rotate with respect to the frame about an axis of rotation, a first pressurized fluid motor presenting a lobed cam fixed with respect to said frame; a cylinder-block fast, with respect to rotation, with said driven shaft; a plurality of cylinders arranged in the cylinder block and disposed radially with respect to the axis of rotation, a plurality of pistons mounted to slide in the cylinders and capable of abutting by reaction on said cam; the shaft being capable of being driven by the first motor at at least a first speed of rotation and presenting a recess which constitutes a passage which, in one configuration of the coupling in rotation of a drilling tool to said shaft, conveys the drilling fluid up to the drilling tool, and the cylinder block of said first motor being coaxial to the axis of rotation.

According to the invention, the following arrangements are adopted: A) this motor unit comprises a second motor, which is coupled in rotation to said shaft and which is capable of driving this shaft at a second speed of rotation substantially higher than said first speed of rotation; B) a first pinion gear is fast with respect to rotation with the shaft, surrounds said shaft and is coaxial to the axis of rotation; C) the second motor presents a driven shaft, with which is fast in rotation a second pinion gear which meshes with said first pinion gear; and D) the first pressurized fluid motor is of the type with "disengageable pistons" and, to that end, is provided with a disengagement mechanism capable of controlling withdrawal of said pistons out of abutment on the lobed cam.

The following advantageous arrangements are preferably adopted:

- the first pressurized fluid motor presents a closed housing containing the cylinder block, capable of selectively communicating with a source of disengaging fluid, such disengagement being effected by the effect of the pressure of the fluid coming from the source of disengaging fluid admitted into the housing, which effects entry of said pistons in the cylinders;
- said second speed of rotation is higher by five times the lowest of the first speeds of rotation;
- the first and second pinion gears are contained in a housing, which is hermetically isolated from the first pressurized fluid motor;

- the diameter of the second pinion gear is smaller than the diameter of the first pinion gear;
- on the one hand, rotational bearings are interposed between the driven shaft and the frame and effect rotational assembly of said shaft with respect to said frame, on the other hand, these rotational bearings also effect rotational assembly of the cylinder block with respect to the lobed cam of the first pressurized fluid motor;
- the first pressurized fluid motor presents a housing, which contains the cylinder block and which is partially constituted by a part of said frame;
- the shaft being capable of driving in rotation a plurality of different tools having likewise different speeds of rotation, the first pressurized fluid motor is a motor presenting a plurality of operational cubic capacities, so as to be able to drive the shaft at several distinct speeds of rotation and thus drive said tools at their respective different speeds of rotation;
- the second motor is a pressurized fluid motor;
- the first pressurized fluid motor comprises a housing which contains the cylinder block, in which said cam is incorporated, and whose outer transverse section, contained in a plane perpendicular to the axis of rotation and intersecting the cam, is capable of being inscribed in a circle of determined diameter, whilst the recess constituting the passage is cylindrical and presents an inner diameter greater than or equal to 0.25 times said determined diameter.

The principal advantage of the invention resides in the obtaining of a satisfactory permanent adaptation of the drive device, both to the various operational phases and to the various tools used.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
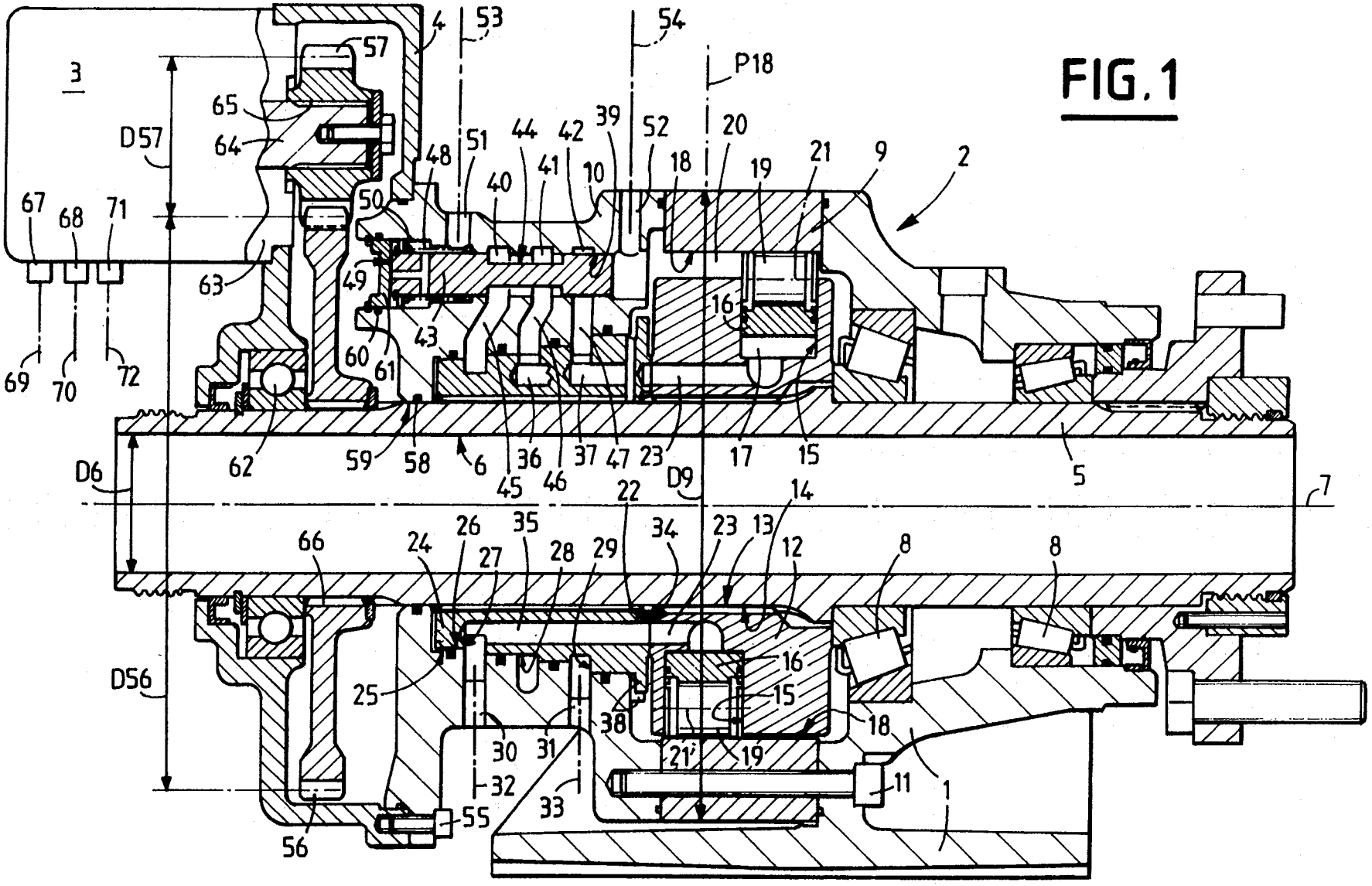
FIG. 1 is an axial section through a motor unit according to the invention.

Referring now to the drawings, the assembly shown in FIG. 1 comprises a frame 1 for fixation, for example on the infrastructure located at the surface of an oil well, a first motor 2, a second motor 3, a speed-reducer housing 4, and a hollow shaft 5 for driving a boring tool (not shown in the Figure), connected to the shaft 5 by hollow boring rods, allowing circulation of the drilling mud between the surface infrastructure and the drilling tool.

Shaft 5 presents an inner cylindrical recess 6, of diameter D6, of axis 7, and is mounted to rotate with respect to said frame 1, about axis 7, by means of bearings 8, conical roller bearings in the embodiment shown.

The first motor is a slow, high-torque hydraulic motor, and comprises:

- a housing in three parts 1, 9 and 10 assembled by screws 11, one of said parts 1 being constituted by a part of the frame 1;
- a cylinder block 12, which presents a bore provided with splines 13, traversed by shaft 5 and rendered fast with said shaft 5 by means of splines 14, with which the shaft 5 is provided and which are imbricated in splines 13;

two rows of cylinders 15, each disposed transversely with respect to axis 7 and comprising a plurality of cylinders 15 disposed radially with respect to axis 7 and angularly distributed about axis 7, substantially regularly;

pistons 16 mounted to slide in cylinders 15, one per cylinder, each defining in the corresponding cylinder a fluid-working chamber 17;

a lobed cam 18, constituted by the inner periphery of the intermediate part 9 of the housing, the bearings 8 thus effecting, via shaft 5 and splines 13–14, the rotational assembly of the cylinder block 12 with respect to cam 18;

rollers 19 mounted at the ends of the pistons 16 opposite the chambers 17 capable either of abutting by reaction on the cam 18 or, on the contrary, in a configuration of "disengagement", of being moved away from cam 18 under the effect of a pressurized fluid contained in the enclosure 20 defined by the housing 1-9-10, each roller 19 being mounted to rotate at the end of said piston about an axis 21 parallel to axis 7;

a plane communication face 22 perpendicular to axis 7, belonging to the cylinder block 12 and into which open out, centred on a circle of axis 7, cylinder conduits 23 each connected to a chamber 17;

an inner fluid distributor valve 24 of which an axial face 25, constituted by a succession of shoulders, has a shape complementary of a housing 26 made in part 10 of the housing, three transverse grooves 27, 28, 29 being formed in the inner fluid distibutor valve 24 and opening out in the axial face 25 and respectively, concerning grooves 27, 29, into conduits 30, 31 made in part 10 of the housing, these conduits 30, 31 being, in addition, connected to outer conduits 32, 33;

a plane distribution face 34, perpendicular to axis 7, belonging to the inner fluid distributor valve 24, maintained in abutment by springs (not shown in FIG. 1) on the communication face 22, and into which open out, centred on the same circle as cylinder conduits 23, distribution conduits 35, 36, 37 made in the inner fluid distributor valve 24 and belonging to three distinct groups of conduits, respectively connected to grooves 27, 28, 29;

a device 38 incorporating associated studs and notches, disposed between part 10 of the housing and the inner fluid distributor valve 24 and allowing slight oscillations of the inner fluid distributor valve with respect to the housing whilst rendering the inner fluid distributor valve 24 fast with the housing with respect to a rotation of axis 7;

a bore 39, formed in part 10 of the housing, into which open out three grooves 40, 41, 42 connected to grooves 27, 28, 29 by conduits 45, 46, 47 respectively, bore in which is slidably mounted a slide valve 43, itself provided with a groove 44 and capable of occupying a first position (shown in FIG. 1) in which groove 44 places grooves 50, 51 in communication and isolates groove 42 from grooves 40, 41, and a second position, in which groove 44 places grooves 41, 42 in communication and isolates groove 40 from said grooves 41, 42;

a pilot chamber 48 made in part 10 of the housing, with which communicates one end 49 of the slide valve 43 forming pilot piston, a spring 50 being disposed between part 10 of the housing and the slide valve 43 and tending to return the slide valve 43 towards its first position, the effect of the pressure of a pilot fluid contained in the pilot chamber 48 being antagonistic to that of the spring 50;

two conduits 51, 52 traversing the wall of part 10 of the housing, and joining pilot chamber 48 and enclosure 20 to outer conduits 53, 54 respectively.

The first motor 2 is a motor with two cubic capacities, known per se, with pistons disengageable under the effect of the pressure of a disengagement control fluid admitted into enclosure 20 via conduit 54, in manner similar to that described in FR-A-2 025 354. The first motor 2 might, in a variant embodiment, be provided with a device for disengaging its pistons comprising springs, as shown in FR-A-2 504 987. The configuration of disengagement obtained in any case corresponds to the retraction inside the cylinders of pistons 16 whose work chambers 17 are no longer supplied with pressurized fluid, the rollers 19 associated with said pistons in that case not being in abutment on cam 18.

It should be observed that, although the general constitution of this first motor 2 is known, it nonetheless presents the following particular feature: the diameter D6 of recess 6 in shaft 5 is particularly large with respect to the outer diameter D9 of part 9 of the housing, measured in a transverse plane P18 intersecting cam 18. In particular, it is advantageous if D6 is greater than or equal to $D9 \times 0.25$, but the embodiment shown does not comprise this advantageous characteristic.

On part 10 of the housing of the first motor 2 is fixed, by screws 55, the housing 4 of a speed reducer comprising a large pinion gear 56 and a small pinion gear 57, which mesh mutually. Housing 4 is distinct from housing 1-9-10 of the first motor, and is insulated from enclosure 20 by an O-ring 58 interposed between shaft 5 and a bore 59 in part 10 of the housing of the first motor traversed by shaft 5, and by an O-ring 60 interposed between part 10 of the housing of the first motor and the removable end bottom 61 defining the pilot chamber 48. A ball bearing 62 is interposed between shaft 5 and the housing 4 of the speed reducer.

On this housing 4 is fixed the housing 63 of the second motor 3 which, in the present case, is a "rapid" hydraulic motor. It is advantageous to use a second motor of hydraulic type by reason of the availability of the elements of the control circuit of the first hydraulic motor, but, in a variant embodiment, this second motor may be of another type, for example electric.

This second motor 3 presents a driving output shaft 64 which is fast with the second pinion gear 57 via associated splines 65, with which these two parts are provided. The first pinion gear 56 is itself fast with shaft 5, which traverses it via associated splines 66 with which these two parts are provided. The first pinion gear 56 is in addition coaxial to axis 7. Finally, the second motor 3 is provided with two principal connections 67, for supplying pressurized fluid and for exhaust of fluid, connected to outer conduits 69, 70, respectively, and is provided with a third connection 71, for return of leakages, connected to an outer conduit 72.

The ratio of diameter D57 of the second pinion gear with respect to diameter D56 of the first pinion gear is less than 1, since it is question of a speed reducer and is here equal to 0.25 ($D57/D56=0.25$).

Figure 2:
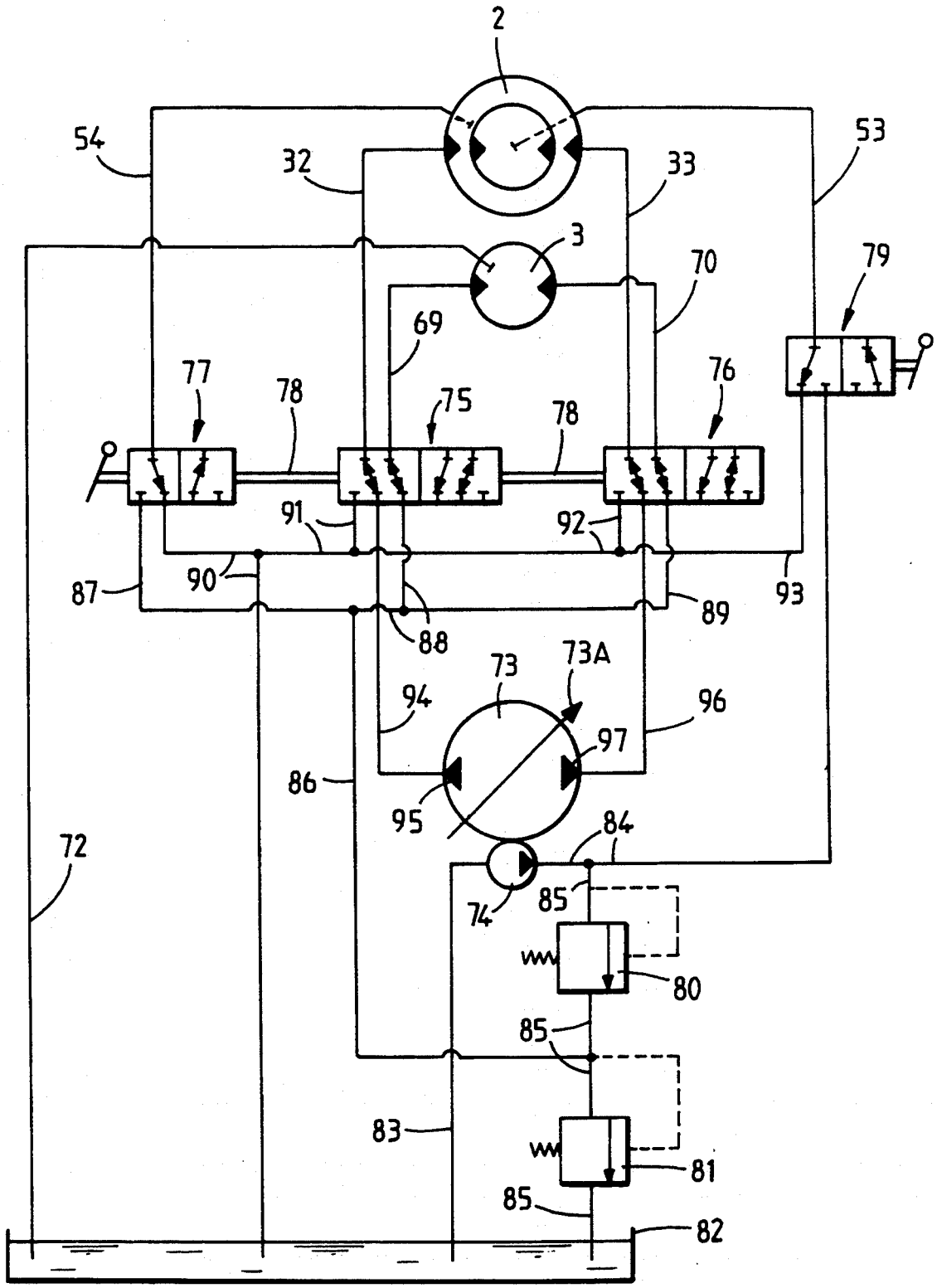
FIG. 2 is the diagram of a circuit controlling the motor unit of FIG. 1.

The control circuit of FIG. 2 comprises the following elements:

the first and second motors 2 and 3;

a principal pump 73, reversible, with variable flow-rate (73A);
a pilot pump 74;
first (75), second (76) and third (77) fluid distributor valves, coupled (78), each with two positions;
a fourth fluid distributor valve 79, likewise with two positions;
a flap valve 80, for maintaining pressure;
a flap valve 81, for maintaining pressure; and
a fluid reservoir 82; and the following conduits:
conduit 32 connected to the first fluid distributor valve 75;
conduit 33 connected to the second fluid distributor valve 76;
conduit 53 connected to the fourth fluid distributor valve 79;
conduit 54 connected to the third fluid distributor valve 77;
suction conduit 83 of the pilot pump 74, connected to the reservoir 82;
delivery conduit 84 of pilot pump 74 connected to the fourth distributor valve 79;
a conduit 85 connecting the delivery conduit 84 to reservoir 82, and on which are disposed flap valve 80 and, beyond flap valve 80 with respect to the connection of conduit 85 to delivery conduit 84, flap valve 81;
a conduit 86 connected to conduit 85 between flap valve 80 and flap valve 81;
a conduit 87 connecting the third fluid distributor valve 77 to conduit 86;
a conduit 88 connecting the first fluid distributor valve 75 to conduit 86;
a conduit 89 connecting the second fluid distributor valve 76 to conduit 88;
a conduit 90 connecting the third fluid distributor valve to reservoir 82;
a conduit 91 connecting the first fluid distributor valve 75 to conduit 90;
a conduit 92 connecting the second fluid distributor valve 76 to conduit 91;
a conduit 93 connecting the fourth fluid distributor valve 79 to conduit 92;
a conduit 94 connecting one, 95, of the principal connections of the principal pump 73 to the first fluid distributor valve 75; and
a conduit 96 connecting the other principal connection, 97, of the principal pump 73 to the second fluid distributor valve 76.

The respective first positions of the first (75), second (76) and third (77) fluid distributor valves correspond:
to the communications of conduits 32 and 94, of conduits 69 and 88, of conduits 33 and 96, of conduits 70 and 89, and of conduits 54 and 90; and
to the obturations of conduits 91, 92 and 87.

The respective second positions of the first (75), second (76) and third (77) fluid distributor valves correspond:
to the communications of conduits 32 and 91, of conduits 69 and 94, of conduits 33 and 92, of conduits 70 and 96, and of conduits 54 and 87; and
to the obturations of conduits 88, 89 and 90.

The two positions of the fourth fluid distributor valve 79 correspond:
the first position, to the communication of conduits 53 and 93, and to the obturation of conduit 84; and
the second position to the communication of conduits 53 and 84, and to the obturation of conduit 93.

The following numerical values are generally admitted:
the calibration pressure of flap valve 80 is equal to 20 bars;
the calibration pressure of the flap valve 81 is equal to 2 bars;
the two speeds of rotation of the first hydraulic motor 2 are equal to 70 and 140 revs per minute;
the speed of rotation of the driving output shaft 64 of the second motor 3 is equal to 2000 revs per minute.

In a variant, the first motor 2 may comprise three distinct cubic capacities and therefore three speeds of rotation, such as 70, 140 and 210 revs per minute.

It should further be observed that, with the first motor 2 with two speeds and the second rapid motor defined hereinbefore, the speeds of rotation of the shaft 5 have the following values:
first speeds of rotation, respectively equal to $V11=70$ and $V12=140$ revs per minute, and
a second speed of rotation equal to $V2=500$ revs per minute.

Thus, the ratio $V2/V11$ of the second speed $V2$ with respect to the smaller of the first speeds is $$V2/V11=500/70=7.14$$

and is greater than 5. This conforms to the use in the same drive unit of a slow motor and a rapid motor.

The functioning obtained is set forth briefly hereinafter.

The fourth fluid distributor valve 79 makes it possible to select the cubic capacity of the first motor 2 (the number of working chambers 17 periodically supplied with pressurized fluid) and enables the slide valve 43 to be placed in its first or in its second position. One of the positions of this fourth fluid distributor valve having been chosen, the speed of rotation of the first motor 2 is also chosen, corresponding to the cubic capacity selected.

Positioning of the first (75), second (76) and third (77) fluid distributor valves in their respective first positions makes it possible:
to cause enclosure 20 to communicate with the pressure-less reservoir 82, via conduits 54 and 90 and therefore to place all the pistons 16 in their "disengagement" configuration in which all the rollers 19 are in abutment on the cam 18;
to connect the supply of the second motor 3 to the exhaust of said motor, via conduits 88-69-70 and 89, and therefore to allow this motor to rotate freely without producing torque; and
to supply the first motor 2 by the principal pump 73 and the conduits 94-32 and 33-96 and thus to drive shaft 5 in rotation at the selected speed of rotation of the first motor.

Shaft 5, and the drilling rods coupled thereto, drives a drilling tool during the phase of penetration of the tool in the ground. For another drilling tool, it may be opportune to select another speed of rotation of shaft 5, which renders possible the selection of the operational cubic capacity of the first motor 2 via the fourth distributor valve 79.

However, in order to bore very hard rocks, it is necessary to be able to drive particular tools such as diamond bits which, to be efficient, require much higher speeds of rotation. In fact, they penetrate the rock by abrasion and not by cutting. During this phase of operation, the effort of penetration becoming low, it is useful to select a speed of rotation much higher than the preceding one. To that end, the first (75), second (76) and third (77) fluid distributors are placed in their respective second positions, which make it possible:

- to cause the enclosure 20 of the housing of the first motor to communicate with the pressure of the fluid retained by the retention valve 81, via the conduits 86-87 and 54, and thus to place pistons 16 in their configuration of "disengagement" in which the rollers 19 are not in abutment on cam 18;
- to connect the supply of the second motor 3 to the principal connection 95 of the principal pump 73 via conduits 94-69 and the exhaust of the same motor to the principal connection 97 of the same principal pump via conduits 70-96, and thus to rotate shaft 5 and the drilling rods coupled thereto via the second motor 3, and pinion gears 57 and 56; and
- to connect the two principal connections of the first motor 2 to reservoir 82 via conduits 32-91-90, on the one hand, and via conduits 33-92-91-90, on the other hand.

Selection of the speed of rotation of the first motor 2 is made as a function of the nature of the terrain and of its reaction to the drilling tool. With a motor with two speeds of rotation (70 and 140 revs per minute, for example), drilling tools of a first type may be driven, whose specific speeds for hard or soft terrains are equal or close to the two speeds of the first motor. Selection of the speed of rotation of the second motor 3 corresponds to the use of a tool of a second type whose specific speed is much higher than those of the tool of the first type. In addition, it is observed that adjustment (73A) of the flow delivered by the principal pump 73 allows an additional adjustment of the speeds of rotation of motors 2 and 3.

Thus, the drive unit drives shaft 5 at the speed of rotation always adapted to the drilling tool used and to the operational phase chosen.

Finally, it must be noted that, as shaft 5 is hollow, it allows circulation of the drilling mud, the dimension D6 of recess 6 rendering this circulation free of restriction.

The invention is not limited to the embodiment described, but, on the contrary, covers all the variants which may be made thereto without departing from its scope nor its spirit.

What is claimed is:

1. A drive unit comprising: a frame; a driven shaft mounted to rotate with respect to the frame about an axis of rotation; a first pressurized fluid motor presenting a lobed cam fixed with respect to said frame; a cylinder block fixed, with respect to rotation, with said driven shaft; a plurality of cylinders arranged in the cylinder block and disposed radially with respect to the axis of rotation; a plurality of pistons mounted to slide in the cylinders and capable of abutting said cam; the shaft being capable of being driven by the first motor at at least one first speed of rotation and presenting a recess which constitutes a passage which conveys drilling fluid to a drilling tool; and, the cylinder block of said first motor being coaxial to the axis of rotation and is disposed about said shaft, wherein:

A) said drive unit comprises a second motor which is coupled in rotation to said shaft and which is capable of driving said shaft at a second speed of rotation substantially higher than said at least one first speed of rotation;

B) a first pinion gear is fixed, with respect to rotation, with the shaft, surrounds said shaft and is coaxial to the axis of rotation;

C) the second motor presents an output shaft with which is fixed, with respect to rotation, with a second pinion gear which meshes with said first pinion gear, D) the first pressurized fluid motor is disengageable and is provided with a disengagement mechanism capable of controlling withdrawal of said pistons out of abutment with the lobed cam.

2. The drive unit of claim 1, wherein the first pressurized fluid motor comprises a closed housing containing the cylinder block, capable of selectively communicating with a source of disengaging fluid which effects entry of said pistons in the cylinders.

3. The drive unit of claim 1, wherein said second speed of rotation is higher by five times a smallest of the at least one first speed of rotation.

4. The drive unit of claim 1, wherein the first and second pinion gears are contained in a housing, which is hermetically isolated from the first pressurized fluid motor.

5. The drive unit of claim 1, wherein a diameter of the second pinion gear is smaller than a diameter of the first pinion gear.

6. The drive unit of claim 1, wherein rotational bearings are interposed between the driven shaft and the frame and effect rotational assembly of said shaft with respect to said frame, and said rotational bearings also effect rotational assembly of the cylinder block with respect to the lobed cam of the first pressurized fluid motor.

7. The drive unit of claim 1, wherein the first pressurized fluid motor comprises a housing which contains the cylinder block, a part of said housing constituted by a part of said frame.

8. The drive unit of claim 1, wherein the shaft is capable of driving in rotation a plurality of different tools at different speeds of rotation, the first pressurized fluid motor is a motor comprising a plurality of operational cubic capacities, so as to be able to drive the shaft at several distinct speeds of rotation and thus drive said tools at their respective different speeds of rotation.

9. The drive unit of claim 1, wherein the second motor is a pressurized fluid motor.

10. The drive unit of claim 1, wherein the first pressurized fluid motor comprises a housing which contains the cylinder block and said cam and having an outer transverse section, contained in a plane perpendicular to the axis of rotation of the cam, said housing capable of being inscribed in a circle of determined diameter, the recess constituting the passage is cylindrical and presents an inner diameter greater than or equal to 0.25 times said determined diameter.

* * * * *